United States Patent [19]

Cyphers

[11] Patent Number: 5,059,099

[45] Date of Patent: Oct. 22, 1991

[54] INTEGRAL PUMP HOUSING

[75] Inventor: Norman A. Cyphers, Rogers, Minn.

[73] Assignee: Wagner Spray Tech Corporation, Minneapolis, Minn.

[21] Appl. No.: 566,326

[22] Filed: Aug. 8, 1990

Related U.S. Application Data

[63] Continuation of Ser. No. 385,035, Jul. 28, 1989, abandoned.

[51] Int. Cl.[5] ..... F04B 9/10; B23P 15/00

[52] U.S. Cl. ..... 417/311; 417/388; 29/888.061

[58] Field of Search ..... 417/307, 311, 383, 385–388, 417/01; 418/178; 92/169; 123/193 C; 29/888.061

[56] References Cited

U.S. PATENT DOCUMENTS

| | | | |
|---|---|---|---|
| 2,814,253 | 11/1957 | Pleuger et al. | 417/388 |
| 3,096,569 | 7/1963 | Cook et al. . | |
| 3,359,909 | 12/1967 | Johnson et al. | 417/388 |
| 3,647,577 | 3/1972 | Gomada et al. | 418/178 |
| 4,395,442 | 7/1983 | Meise | 29/156.4 WL |
| 4,486,938 | 12/1984 | Hext | 29/402.06 |
| 4,494,297 | 1/1985 | Larsson | 29/527.6 |
| 4,653,161 | 3/1987 | Sanchez | 29/156.4 R |
| 4,656,710 | 4/1987 | Maciejewski | 29/156.4 WL |
| 4,779,665 | 10/1988 | Ouimet | 164/120 |
| 4,789,301 | 12/1988 | Osborne et al. | 415/206 |
| 4,883,412 | 11/1989 | Malizard et al. . | |
| 4,896,409 | 1/1990 | Rosch et al. | 29/157.1 R |
| 4,969,263 | 11/1990 | Adams | 29/888.06 |

FOREIGN PATENT DOCUMENTS

| | | | |
|---|---|---|---|
| 1095123 | 12/1960 | Fed. Rep. of Germany | 417/387 |
| 3202788 | 8/1982 | Fed. Rep. of Germany | 123/193 C |
| 3151764 | 9/1982 | Fed. Rep. of Germany | 417/388 |
| 1262623 | 4/1961 | France | 417/386 |
| 148691 | 1/1984 | World Int. Prop. O. | 417/387 |

OTHER PUBLICATIONS

Lindberg, Roy, Processes of Material and Manufacture, 1969, pp. 435–437.

McGraw-Hill Dictionary of Scientific and Technical Terms, Third Ed., 1984, p. 323.

*Primary Examiner*—Richard A. Bertsch

*Assistant Examiner*—John A. Savio, III

*Attorney, Agent, or Firm*—Faegre & Benson

[57] ABSTRACT

An integral cylinder liner and pump housing formed of a die cast aluminum workpiece of the type having a surface hardness extending a minimum depth into the workpiece, the housing further includng and integral pressure vessel and pressure control valve housing and fluid return path.

8 Claims, 4 Drawing Sheets

INTEGRAL PUMP HOUSING

This is a continuation of copending application Ser. No. 07/385,035 filed on Jul. 28, 1989 now abandoned.

FIELD OF THE INVENTION

This invention relates to improvements in aluminum die casting, more particularly to such die castings used for pump housings and other applications where an integral hard working surface is advantageous.

BACKGROUND OF THE INVENTION

Aluminum die castings have been used for equipment housings for many years. The many advantageous mechanical properties of aluminum die castings have motivated widespread usage of such die castings for pump housings. In the past, it has been found necessary to use a separate pressure vessel, preferably steel, within the housing to serve as a cylinder for the piston of such pumps due to the perceived poor wear characteristics and porosity of aluminum.

In addition, other parts and subassemblies were often present with the consequent increase in cost and complexity.

In one aspect of the present invention, it has been found possible to eliminate separate parts such as the pressure vessel in such assemblies while at the same time achieving improved wear characteristics over conventional or "soft" aluminum, such as, for example type 380.

The present invention accomplishes this by utilizing the relatively hard but thin surface region or skin of approximately 0.015 to 0.030 depth which appertains to aluminum die casting. In the past, such a skin was typically machined away leaving only the soft (and possibly porous) bulk aluminum which is unacceptable as a working surface. In the present invention, the workpiece is die cast to near net shape and subsequently only finish machined such that a portion of the hard surface region remains in the aluminum and is available as a hard working surface having a desired configuration and surface finish. An additional or side benefit of this invention is that, by leaving a portion of the hard skin on the die casting, the characteristic lower porosity of the skin can be utilized as well.

It is believed that the mechanical properties of die castings are directly related to solidification rate. The aluminum alloy composition can be used to vary the hardness and machinability; the cooling rate and injection pressure can also be controlled to regulate surface hardness of the die casting; entrapped gases can also affect hardness. The microstructural features that affect hardness in such die castings are: i) grain size and shape, ii) dendrite-arm spacing, and iii) the size and distribution of second-phase particles and inclusions.

Another aspect of the present invention is the utilization of portions of the equipment or pump housing to replace discrete parts from prior art assemblies. More specifically, in the practice of the present invention, a pressure control valve housing, fluid return path, and stop for the pressure control valve are preferably cast integral with the pump housing. In addition, a valve seat may be formed integral with the pump housing by machining and coining a conical surface in the housing.

DETAILED DESCRIPTION

Figure 1:
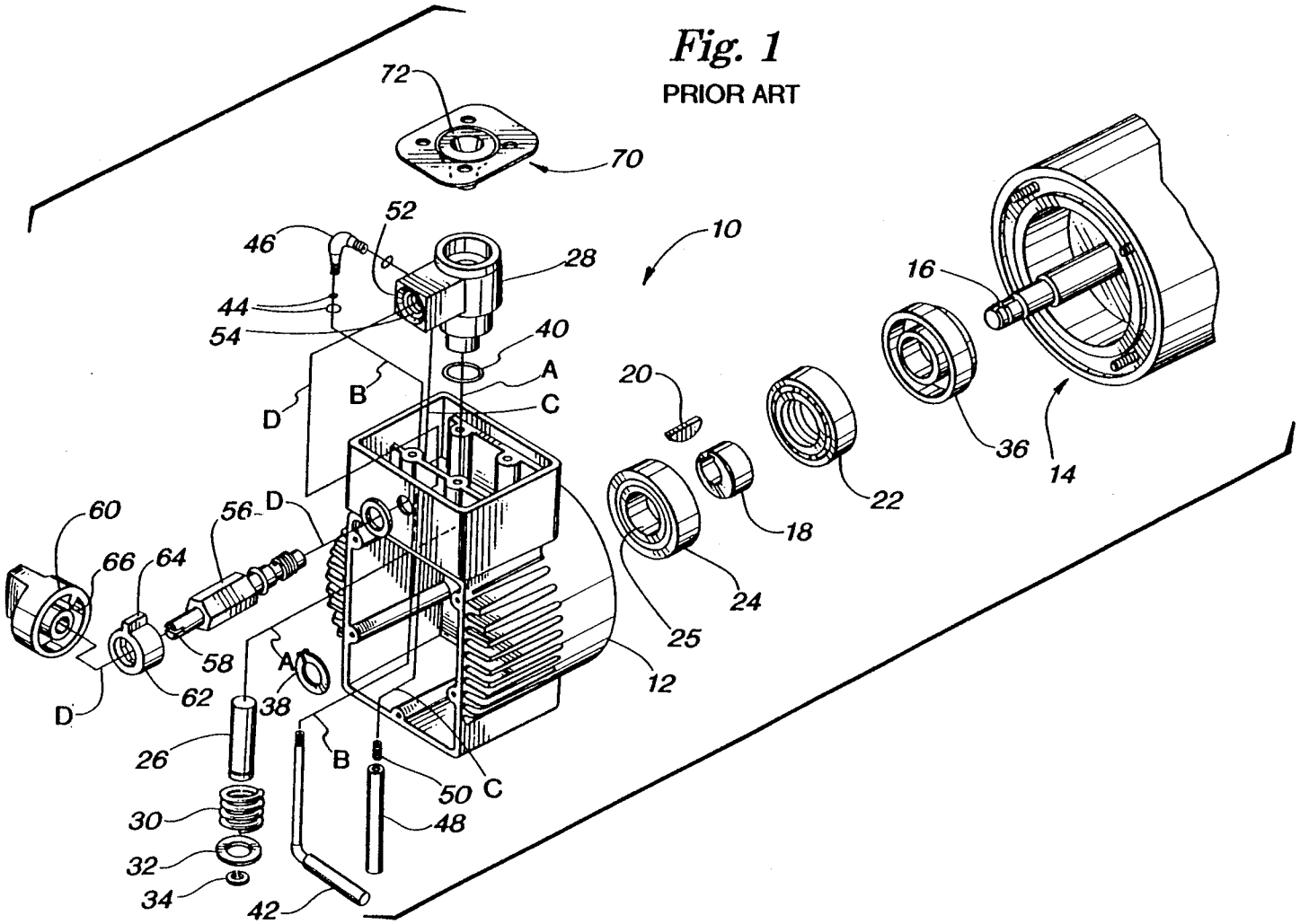
Fig. 1 PRIOR ART
FIG. 1 is an exploded view of selected parts of a prior art pump assembly.

Referring more particularly to FIG. 1, in the prior art, a pump assembly 10 preferably included an aluminum die cast housing 12 containing a number of additional parts to form a hydraulic pump operating from an electric motor 14 secured to housing 12.

Assembly 10 includes a motor shaft 16 driving an eccentric 18 secured to shaft 16 by key 20. Shaft 16 rotates in a ball or roller bearing 22 with respect to housing 12. Eccentric 18 rotates in a bearing 24 operating to drive a piston 26 upward along axis A in a pressure vessel 28. A spring 30 drives against a washer 32 held on piston 26 by a retaining ring 34. A shaft seal 36 is preferably located adjacent bearing 22. A retaining ring 38 secures eccentric 18 from axial movement along shaft 16.

It is to be understood that eccentric 18 is preferably press-fit to the inner race 25 of bearing 24.

Pressure vessel 28 is sealed against housing 12 by an O-ring 40. An oil pick up tube 42 is coupled along axis B via O-rings 44 to elbow 46. Elbow 46 is received in pressure vessel 28 along a radial aperture whose axis intersects axis A.

An oil return tube 48 is coupled via a plastic barbed fitting 50 along axis C to a rectangular projection 52 on pressure vessel 28. Rectangular projection 52 has a threaded bore 54 which receives a pressure valve housing 56 along axis D. Housing 56 encloses a needle valve assembly having a stem 58. Stem 58 receives a knob 60 along axis extension D'. A plastic stop 62 is preferably interposed between valve housing 56 and knob 60. Stop 62 has a hexagonal-shaped bore to mate with housing 56 and an external projection 64 which is engageable with an internal projection 66 on knob 60 to limit the rotation of stem 58 to less than 360°.

A nylon diaphragm assembly 70 rests above pressure vessel 28 and flexes in response to reciprocation of piston 26. Diaphragm 72 of assembly 70 provides a pumping action to a paint pump assembly (not shown).

Figure 2:
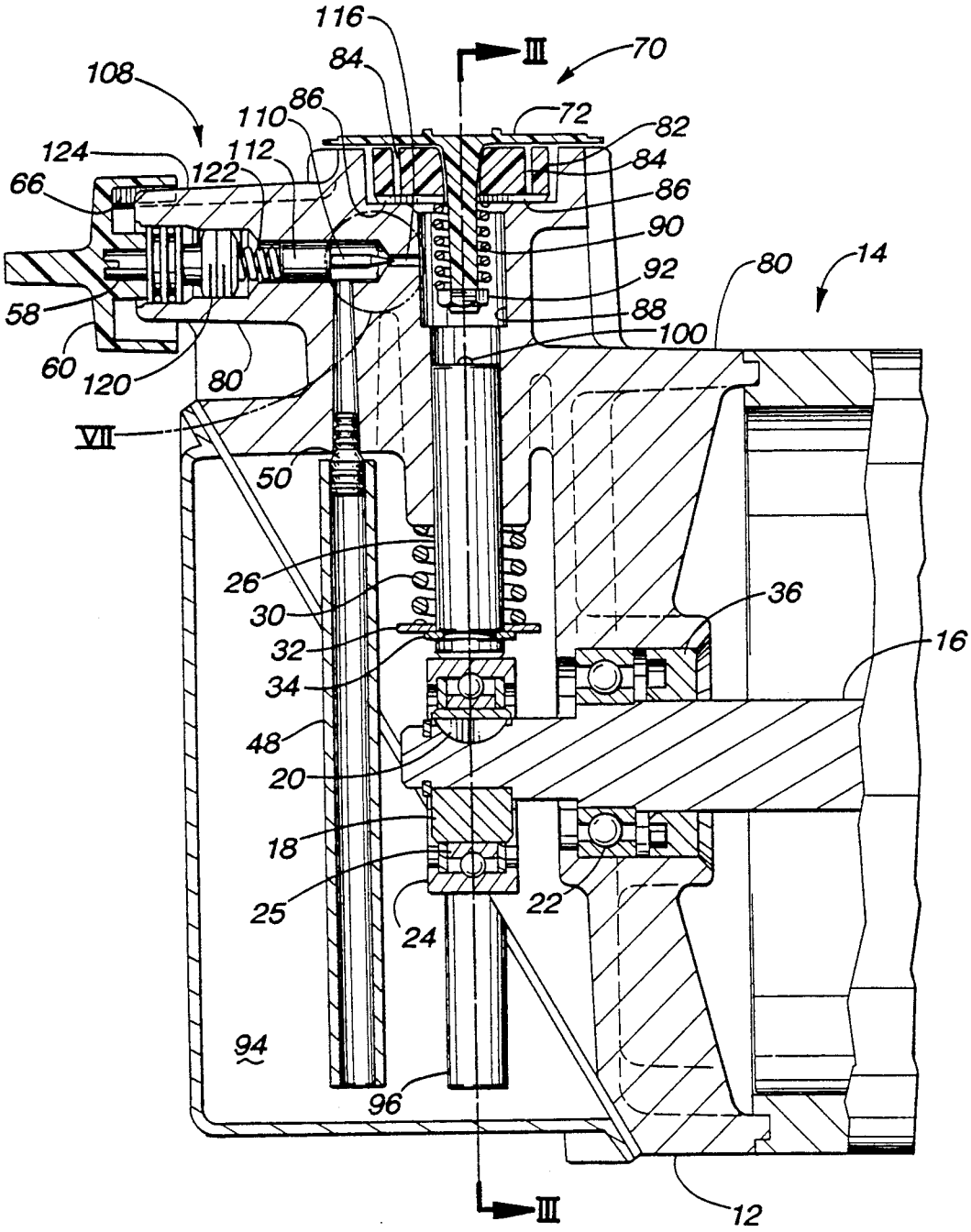
FIG. 2 is a fragmentary side elevation view of the pump housing of the present invention in assembly with parts cut away, sectioned vertically along a central axis of the assembly.

Referring now more particularly also to FIG. 2, in the present invention, although a number of the operating parts from the prior art assembly of FIG. 1 are utilized, it is to be noted that the pressure vessel 28, pressure valve housing 56, and stop 62 have been eliminated, along with a number of additional parts, resulting in substantial cost savings.

Figure 3:
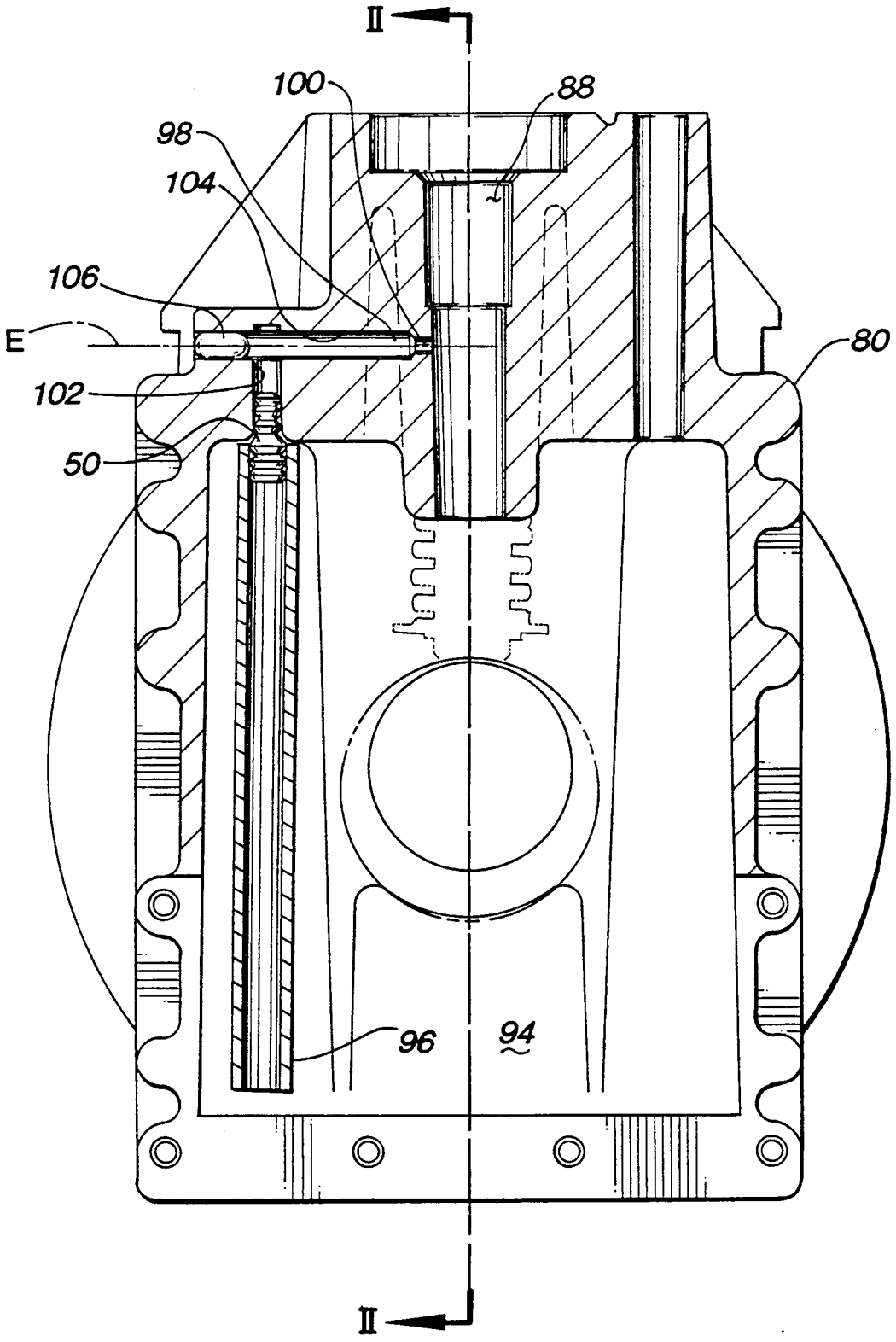
FIG. 3 is an end elevation view of the pump housing of FIG. 2 with parts omitted.

In the practice of this invention, a redesigned aluminum die cast housing 80 is preferably formed of type 380 aluminum and machined to the configuration shown in FIGS. 2 and 3.

The diaphragm assembly (which is common to the embodiments of FIG. 1 and 2) includes diaphragm 72 preferably formed of nylon. A cylindrical spacer block 82 has a plurality of through holes 84 to permit oil to reach diaphragm 72. Block 82 also Preferably has channels 86 to permit delivery of oil from chamber 88 to holes 84. Spring 90 acting between block 82 and nut 92 urges diaphragm 72 against the top of block 82. Oil is supplied from sump 94 through oil supply tube 96, barbed fitting 50' and passageway 98 through aperture 100 to chamber 88.

Passageway 98 is preferably formed of two segments, 102, 104. Segment 102 is preferably cast in housing 80 and segment 104 is preferably formed by drilling housing 80 along axis E. A pin 106 is inserted in segment 104 to seal passageway 98 against the environment exterior of housing 80.

Figure 7:
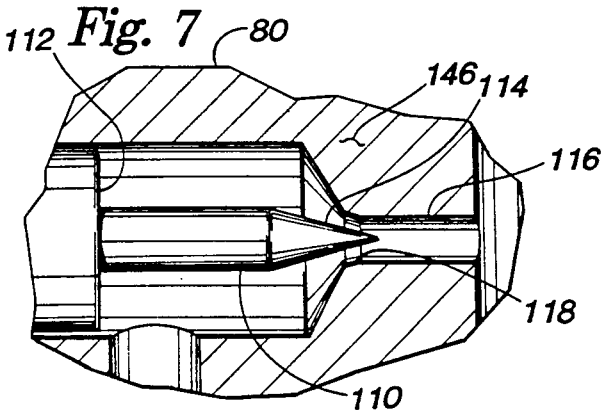
FIG. 7 is an enlarged fragmentary view taken from the area 7 in FIG. 2.

Referring now also to FIG. 2, a pressure valve 108 includes a needle 110 press-fit and secured into a generally square cross section carrier 112. Needle 110 preferably has a cone-shaped tip 114 having an included angle preferably between 30° and 31°. As may be seen more clearly in FIG. 7, housing 80 is drilled to provide passageway 116 and preferably coined to provide cone-shaped section 118 having an included angle preferably between 31° and 33°. Housing 80 is also preferably threaded to receive valve body 120 rotatable via valve stem 58. A spring 122 resiliently urges needle 110 against cone-shaped section 118.

Figure 8:
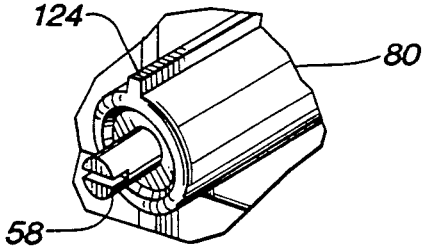
FIG. 8 is a fragmentary perspective detail of part of the assembly of FIG. 2.

Referring now also to FIG. 8, a stop 124 is preferably cast integral with housing 80, eliminating the need for a separate stop 62.

Figure 4:
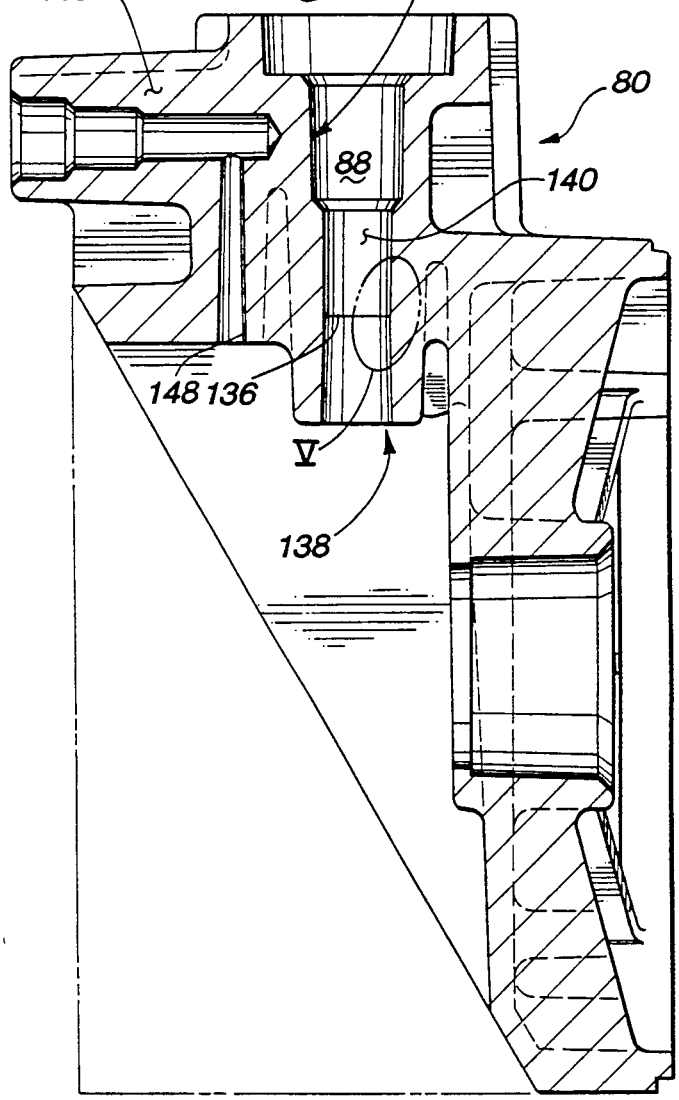
FIG. 4 is a view similar to that of FIG. 2 showing the housing in an as-cast condition.

Referring now to FIG. 4, housing 80 is shown in the as-cast condition. It is to be understood that FIG. 4 is sectioned at the same plane as FIG. 2.

Figure 5:
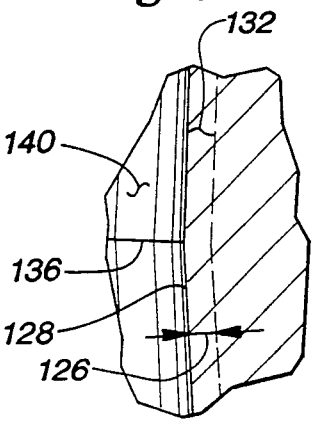
FIG. 5 is an enlarged fragmentary view taken from area 5 of FIG. 4.
Figure 6:
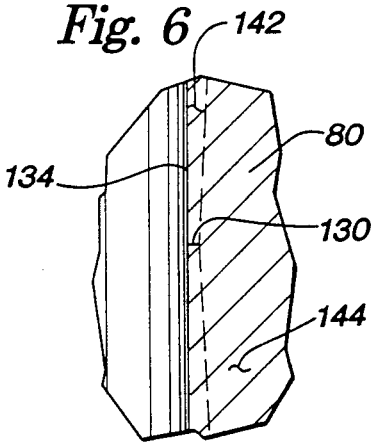
FIG. 6 is a view similar to that of FIG. 5 showing the same detail after machining.

Referring also to FIG. 5, housing 80 is an aluminum die casting of the type having a region of increased hardness extending a minimum depth 126 below a surface 128 of die casting 80 as cast. Casting 80 is machined to a depth 130 less than the minimum depth 126 of the increased hardness region 132 to form a hard working surface 134 on die casting 80 to a desired configuration and surface finish. In the region shown in FIGS. 5 and 6, it is to be understood that a double core is used in the die casting process with a parting line 136 separating the cores. Each core is tapered in the form of a truncated cone with the diameter increasing as distance progresses away from parting line 136. This results in a region of increased hardness generally forming a cylindrical region surrounding a bore 138 cast in the die casting or workpiece 80. In the configuration shown in FIGS. 4 and 5, the cylindrical region 140 has a slight hourglass taper. The minimum depth 126 of increased hardness is in the range of 0.010 to 0.040 inches as measured normal or perpendicular to surface 128 of the die casting 80. The die casting 80, as has been said, is preferably formed of type 380 aluminum, however, other materials may be utilized which will result in an increased hardness region 132.

It may thus be seen that an integral cylinder liner 142 is formed with housing 80 wherein the aluminum die casting 80 has an as-cast bore radius surrounded by a generally cylindrical region 132 of increased hardness of a predetermined minimum depth 126 from a surface 128 of bore 138 and machined to a finished radius slightly larger than the as-cast bore radius wherein the finished radius is less than the sum of the as-cast bore radius and the minimum depth 126 such that the integral finished cylinder liner 142 is formed in die casting 80 at the finished radius and has an increased surface hardness with respect to interior hardness of die casting 80 in region 144. It is to be understood that with respect to FIG. 6, that if it is not necessary that a surface of increased hardness extend fully along the entire cylinder wall, that depth 130 may actually be negative inasmuch as machining may remove all of the region 132 in the vicinity of parting line 136 while still retaining a region of increased hardness 132 remote from the vicinity of parting line 136. Such a configuration would, in effect,, result in two bands of increased hardness separated by a region lacking such increased hardness and is believed to be adequate for the functioning of providing a hard working surface against which piston 26 may operate. In such a circumstance, it is to be understood that the porosity of casting 80 must be carefully controlled to eliminate seepage or leakage in the vicinity of parting line 136. Casting 80 may be made impervious to oil leakage by any one of a number of conventional techniques, such as resin impregnation.

Referring to FIG. 4, it is further to be understood that a single conical taper for bore 138 may be advantageous in certain applications of this invention, while in the configuration as shown in FIG. 4, it is preferred that bore 138 has a double conical taper as cast. It is further to be understood that in machining bore 138 to arrive at the configuration shown in FIG. 2, that the integral finished cylinder liner 142 will preferably be a right circular cylinder.

In operation, piston 26 moves upward past aperture 100, closing off chamber 88, causing oil to exert pressure on diaphragm 72 which will flex, acting as a pumping element and liquid seal between the hydraulic pump shown herein and a separate paint pump (not shown). At the same time, the oil pressure will unseat needle 110 from seat 118 regulating the oil pressure in chamber 88 by the action of spring 122 whose force is set by the axial position of valve body 120 positionable via knob 60. Oil which leaks past needle 110 is returned to sump 94 via passageway 116 and fluid return path 148.

It may thus be seen that a non-isotropic hardness integral aluminum paint sprayer hydraulic pump cylinder and housing may be formed from a homogeneous die cast aluminum housing 80 having a hourglass-tapered bore 138 cast therein with the bore 138 surrounded by a circumferential hourglass-tapered region 132 of increased hardness with respect to a bulk interior hardness of said housing at region 144 with the bore machined to a right circular cylindrical configuration while remaining within the circumferential increased hardness region 132.

It is further to be understood that in the practice of this invention, a one-piece pump housing may be formed by housing 80, a hydraulic piston pump cylinder 142 cast integral with the pump housing 80 and furthermore including a pressure controlled valve housing region 146 also cast integral with the pump housing 80. The fluid return path 148 is also preferably cast integral with pump housing 80 with path 148 extending from the valve housing 146 towards a fluid sump 94. The housing 80 furthermore preferably has a pressure control valve stop 124 cast integral with pump housing 80.

Referring to FIGS. 3 and 4, chamber 88 is preferably surrounded by a region 150 which comprises a pressure vessel integral with housing 80.

It is also to be understood that valve housing 146 preferably further includes cone-shaped section 118 coined in housing 80 to form a valve seat integral with pump housing 80.

The invention is not to be taken as limited to all of the details thereof as modifications and improvements may be made while remaining within the spirit and scope of the invention as claimed.

What is claimed is:

1. A one-piece die-cast aluminum pump housing comprising:

a) a hydraulic piston pump cylinder cast integral with the pump housing and having a hard working surface bore with a finished radius greater than an as-cast radius of said bore and less than a radius of an increased hardness cylindrical region surrounding said as-cast bore, said increased hardness cylindrical region formed solely by the die casting process and wherein said hard working surface bore is formed solely by a reduced depth of said increased hardness cylindrical region; and b) a pressure control valve housing cast integral with said pump housing.

2. The pump housing of claim 1 further comprising:

d) a fluid return path die cast integral with said pump housing, said path extending from said valve housing towards a fluid sump.

3. The pump housing of claim 1 wherein the pump cylinder has a surface hardness greater than an interior hardness of said pump housing in the absence of any coating on said pump cylinder.

4. The pump housing of claim 1 wherein the pressure control valve housing further comprises:

a radially outwardly projecting pressure control valve stop case integral with said pump housing positioned on said housing to engage a radially inwardly directed projection on a pressure control knob.

5. The pump housing of claim 1 wherein the pump cylinder and valve housing comprise a pressure vessel for said pump housing.

6. A one-piece die-cast aluminum pump housing having a hard working surface forming a hydraulic piston pump cylinder made by the process of:

a) die casting an aluminum pump housing to a near net shape with a hydraulic piston pump cylinder of near net shape and simultaneously die casting a pressure control valve housing integral therewith, said near net shape pump cylinder having a region of increased hardness extending a minimum depth below a surface of said near net shape pump cylinder as cast;

b) machining said near net shape pump cylinder only to a depth less than said minimum depth of said increased hardness region to form a hard working surface on said pump cylinder.

7. The pump housing of claim 6 wherein the pressure control valve housing further comprises:

a radially outwardly projecting pressure control valve stop case integral with said pump housing positioned on said housing to engage a radially inwardly directed projection on a pressure control knob.

8. The pump housing of claim 6, wherein the pump cylinder and valve housing comprise a pressure vessel for said pump housing.

* * * * *